United States Patent [19]

Staisch

[11] 4,441,865

[45] Apr. 10, 1984

[54] FLUID PRESSURE PUMP

[75] Inventor: Diether Staisch, Walsrode, Fed. Rep. of Germany

[73] Assignee: WABCO Fahrzeugbremsen GmbH, Hanover, Fed. Rep. of Germany

[21] Appl. No.: 327,316

[22] Filed: Dec. 4, 1981

[30] Foreign Application Priority Data

Dec. 20, 1980 [DE] Fed. Rep. of Germany ..... 3048265

[51] Int. Cl.[3] ..... F04B 9/00; F04B 35/00

[52] U.S. Cl. ..... 417/319; 417/569; 74/570

[58] Field of Search ..... 417/319, 559, 571, 273; 92/18, 19, 20; 403/2; 74/570, 588

[56] References Cited

U.S. PATENT DOCUMENTS

| | | | |
|---|---|---|---|
| 603,805 | 5/1898 | Wood | 417/273 |
| 1,126,012 | 1/1915 | Huff | 417/319 |
| 1,477,300 | 12/1923 | Kraft | 417/273 |
| 2,309,551 | 1/1943 | Trapp et al. | 417/273 |
| 2,635,544 | 4/1953 | Lossau | 417/273 |

FOREIGN PATENT DOCUMENTS

| | | | |
|---|---|---|---|
| 2258696 | 6/1973 | Fed. Rep. of Germany | 417/273 |

*Primary Examiner*—William L. Freeh

*Attorney, Agent, or Firm*—J. B. Sotak

[57] ABSTRACT

A fluid pressure pump having a cylinder housing which contains a reciprocating position. A crankshaft housing attached to the cylinder housing and having a rotary drive shaft which turns an eccentric. A slide shoe pivotally connected to the reciprocating piston and normally held in frictional engagement with the eccentric by a split-ring spring. The split-ring spring ungirds the frictional engagement with the eccentric during a seizure of the piston.

6 Claims, 1 Drawing Figure

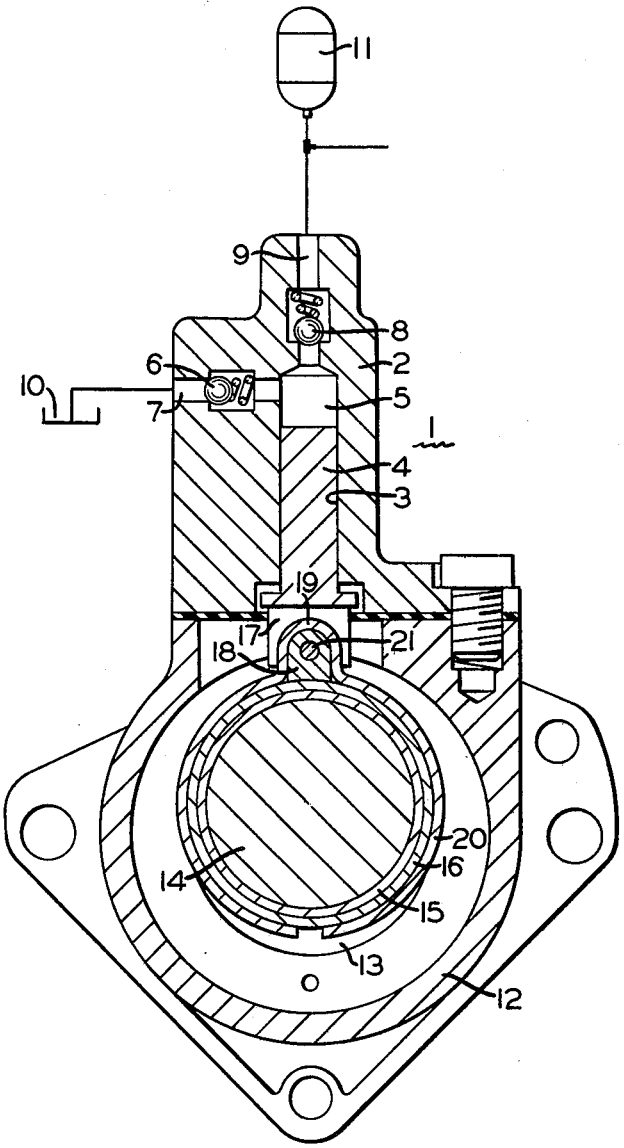
11
9
8
2
6
10
7
5
1
4
3
19
17
21
18
20
16
14
15
13
12

FLUID PRESSURE PUMP

FIELD OF THE INVENTION

This invention relates to a fluid pressure pump, and more particularly to a hydraulic pump having a reciprocating piston which is pivotally interconnected to a rotary drive eccentric by a split-ring spring which is rendered ineffective during seizure of the piston.

BACKGROUND OF THE INVENTION

Previous fluid pressure pumps of the force type were used to draw a hydraulic fluid through a suction valve from a supply tank, and in the case of a reciprocating hydraulic pump, a piston was activated by a cam to pump the fluid under pressure through a pressure valve into a consumption pipe.

A fluid pressure pump of this type is shown and described in West German Preliminary Published Patent DE-OS 28 13 858. This type of fluid pressure pump includes a piston which is under the force of a spring. The spring is situated on the pump chamber side of the piston. Further, the other side of the piston is in sliding contact with the cam. One of the disadvantages of such an arrangement is that the spring is subject to rapid fatigue since it is constantly affected by changing temperatures and varying loads. Thus, such a spring-biased fluid pressure pump is susceptible to early fatigue.

OBJECTS OF THE INVENTION

Accordingly, it is an object of the invention to provide a new and improved fluid pressure pump which is simple in design and which has an improved piston drive.

A further object of this invention is to provide a unique hydraulic pump having a cylinder housing which includes a bore. A reciprocating piston is disposed within the cylinder bore and forms a pump chamber at one end thereof. A crankshaft housing is mounted on the pump housing. A rotatable drive shaft is carried by the crankshaft housing. An eccentric is connected to the rotatable drive shaft for activating the reciprocating piston. A spring flexibly links the piston to the eccentric. The spring takes the form of a split-ring which is pre-loaded and which frictionally engirds the eccentric and which becomes released when the force transmitted by the piston exceeds the pre-loaded force.

The above advantages and objects are achieved with the subject invention by providing a novel spring arrangement for a fluid pressure pump wherein the piston is flexibly and frictionally connected by a split-ring spring to a rotatable eccentric and is driven in a manner which saves an exceptional amount of energy since the necessity of overcoming or working against the force of a spring is eliminated.

The open annular shape of the spring means that the frictional coupling between the piston and the eccentric can be readily disconnected when the force transmitted by the piston exceeds the compressive force of the spring. For example, when there is increased friction between the piston and the wall of the cylinder bore during a seizure of the piston, the resulting damage to the fluid pressure pump is safely prevented.

The arc-shaped portion of the slide shoe on the piston side and the openings located in the center of the slide shoe and in the bifurcations of a yoke on the piston interact so that the spring may be in close contact with the slide shoe. This avoids any additional fastening on the slide shoe. Thus, the shoe can be pivotally connected by means of a pin to the yoke, and the slide shoe can follow the movement of an eccentric.

A bearing ring is rotatably mounted on the eccentric so that the spring and the slide shoe are in pre-loaded contact with the bearing ring. Thus, the bearing ring rotates around the eccentric so that friction wear on the slide shoe and on the spring is prevented.

BRIEF DESCRIPTION OF THE DRAWING

The above objects and other attendant features and advantages of the present invention will become more readily apparent from the following detailed description when considered and reviewed in conjunction with the accompanying drawing, in which:

The single FIGURE is an elevational cross-sectional view of the fluid pressure pump of a preferred embodiment of the present invention.

As shown, a fluid pressure pump is generally characterized by the number 1. The pump 1 includes an upper barrel or pump housing 2 which is provided with a cylinder bore 3.

It will be seen that a piston 4 is disposed within the cylinder bore 3. The piston 4 can move and reciprocate with the bore 3. A working or pump chamber 5 is formed in the upper end of cylinder bore 3.

The pump chamber 5 can be connected by means of a spring-loaded suction or inlet valve 6 with an inlet port 7, and by means of spring-loaded pressure or outlet valve 8 with an outlet port 9. The inlet port 7 is connected to a supply source or tank 10 while the outlet port 9 is connected to a storage tank or reservoir 11 for subsequent consumer usage.

The upper housing 2 is fitted with and is attached to the top of a lower crankshaft housing 12. The piston 4 is reciprocated by the crankshaft drive which engages with the end opposite the pump chamber 5. As shown, the crankshaft housing 12 includes a drive shaft 13 which is mounted for rotational movement. The shaft 13 is torsionally connected to an eccentric 14. The eccentric 14 has a bearing ring 16 which can rotate about an intermediately disposed molded lubricant sleeve 15.

At the bottom end facing the crankshaft housing 12, the piston 4 has an apertured clevis or yoke member 17 which may be pivotally or flexibly coupled to a sliding shoe 18. The pivotal slide shoe 18 has a semi-circular or arc shape formed on its upper surface and has a hole 19 formed in the center thereof. The shoe 18 cooperates with an arcuate loop formed in a coil spring 20. That is, the upper peripheral portion of the spring 20 is formed with matching arc-shaped portion which closely contacts and communicates with the shoe 18. Thus, the spring 20 and the shoe 18 are flexibly linked and are pivotally connected to the bifurcations or arms of apertured yoke member 17 by means of a pivot pin 21 which passes through the hole 19.

As shown, the spring member 20 is designed as a split-ring or an open-annular spring which encircles or engirds the eccentric 14 in biasing engagement like a pair of tongs. That is, the spring 20 engages the outside of the bearing ring 16 which cooperates with the eccentric 14 through the lubricating ring 15.

Thus, the slide shoe 18 effectively follows the cam surface of the eccentric 14 via rings 15 and 16 and the spring 20 when there is normal friction between walls of the piston 4 and the cylinder bore 3. Accordingly, the piston 4 is reciprocated by the rotational movement of the eccentric 14. However, when an increased amount of friction causes the piston 4 to freeze or stop within the cylinder, the intimate contact between the slide shoe 18 and the ring 16 will cease to exist since the split spring 20 will open and ride up the sides of the bearing ring 16. Thus, the eccentric 14 will cease to drive shoe 18 and the piston 4 remains in the position that it reaches at its maximum working stroke. It will be appreciated that the maximum effort is reached when the piston 4 is moving in the direction of the pump chamber 5.

In describing the operation of the fluid pressure pump 1, it will be assumed that the various parts or elements are in the position as shown in the single FIGURE of the drawing.

Thus, the fluid pressure pump 1 is shown in its inactive position, with the piston 4 at top dead center. The piston 4 is frictionally engaged with the eccentric 14 by means of the slide shoe 18 which contacts the roller ring 16. The tension of the split-ring spring 20 normally maintains the intimate contact between the shoe 18 and the roller ring 16. In the position shown, the outlet port 9 is shut off by the pressure valve 8, and the inlet port 7 is shut off by the suction valve 6. Thus, there is no open return flow path from the outlet port 9 to the supply tank 10 which is connected with the inlet port 7.

The fluid pressure pump 1 is ordinarily activated when the eccentric member 14 which can resolve within the roller ring 16 is rotated by the drive shaft 13. The piston 4 is thereby moved downwardly and then upwardly in the cylinder bore 3. That is, the slide shoe 18 is maintained in intimate contact with the roller ring 16 by the biasing pressure of the spring 20 so that the piston 4 makes, in alternating sequence, an intake or downward stroke and a working or upward stroke.

During intake stroke, a suction action takes place or occurs in the pump chamber 5, so that the suction valve 6 opens and a given amount of fluid is sucked up from the supply tank 10. Conversely, during the working stroke, a pressure buildup occurs in the pump chamber 5 since the suction valve 6 is closed; however, the pressure valve 8 will be opened and the fluid in chamber 5 is pumped through the outlet port 9 into the reservoir 11.

Now if an increase in the friction between the piston 4 and the cylinder bore 3 takes place, the intimate connection between the shoe 18 and the eccentric 14 becomes disengaged since the spring 20 is unable to retain full frictional contact with the bearing ring 16. Thus, the piston 4 remains in its given position at the maximum work stroke. Thereby, the fluid pressure pump 1 is inactive since the driven eccentric 14 is unable to reciprocate the shoe 18 during a seizure of the piston 4. Accordingly, there is no resulting damage to the fluid pressure pump 1 in an excessive friction or frozen piston condition.

It will be appreciated that the open annular shape of the spring 20 is designed so that its free ends will not slide beyond the center or horizontal diameter of the bearing ring 16. Then, the slide shoe 18 automatically returns to the frictional engagement with the eccentric 14 as shown in the drawing by the spring tension when the piston has been restored to its normal operation.

In addition, this frictional engagement between the shoe 18 and the eccentric 14 can also be released if the force of the spring 20 is overcome for other reasons, for example, if the piston becomes stuck on account of a foreign object in chamber 5.

It will be appreciated that various changes and modifications can be made by one skilled in the art without deviating from the spirit and scope of the present invention. For example, the spring 20 can also be directly linked to the piston 4 by means of an eye on the spring or a lug, and the pin 21. Thus, the slide shoe 18 can be eliminated, if the spring 20 is designed to be strong enough in the connection region. Accordingly, it is understood that all changes, variations and equivalents within the metes and bounds of the subject invention are herein meant to be encompassed in the appended claims.

Having thus described my invention, what I claim as new and desire to secure by Letters Patent, is:

1. A fluid pressure pump comprising, (a) a pump housing, said pump housing including a cylinder bore and inlet and outlet valves, (b) a reciprocating piston disposed within the cylinder bore for forming a pump chamber on one end thereof, (c) a crankshaft housing mounted on said pump housing, a rotatable drive shaft carried by said crankshaft housing, (d) an eccentric connected to said rotatable drive shaft for activating said reciprocating piston, (e) a spring flexibly linking said piston to said eccentric, (f) said spring takes the form of a split-ring which is pre-loaded and which frictionally engirds said eccentric and which becomes released when the force transmitted by said piston exceeds the preloaded force.

2. The fluid pressure pump as defined in claim 1, wherein a pivot pin connects said piston to said spring.

3. The fluid pressure pump as defined in claim 2, wherein said pivot spring is connected to a slide shoe which includes a hole for accommodating said pin.

4. The fluid pressure pump as defined in claim 3, wherein said slide shoe includes an arcuate curved portion situated on the piston side and said hole is centrally located with respect to said portion.

5. The fluid pressure pump as defined in claim 3, wherein said spring encompasses said slide shoe on the piston side, and said pivot pin is pivotally connected to a yoke which is connected to said piston.

6. The fluid pressure pump as defined in claims 1 to 4, wherein said eccentric includes an outer bearing ring which is normally in frictional contact with said spring and said slide shoe.

* * * * *

UNITED STATES PATENT AND TRADEMARK OFFICE

CERTIFICATE OF CORRECTION

PATENT NO. : 4,441,865

DATED : April 10, 1984

INVENTOR(S) : Diether Staisch

It is certified that error appears in the above-identified patent and that said Letters Patent are hereby corrected as shown below:

Column 4, line 45, before "pin" insert --pivot--

Signed and Sealed this

Fourth Day of September 1984

[SEAL]

*Attest:*

GERALD J. MOSSINGHOFF

*Attesting Officer*

*Commissioner of Patents and Trademarks*